US006293248B1

(12) United States Patent
Zsoldos et al.

(10) Patent No.: US 6,293,248 B1
(45) Date of Patent: Sep. 25, 2001

(54) TWO-CYCLE COMPRESSION BRAKING ON A FOUR STROKE ENGINE USING HYDRAULIC LASH ADJUSTMENT

(75) Inventors: Jeffrey S. Zsoldos, Mount Airy; Joseph H. Schmidt, Hagerstown, both of MD (US); John B. Bartel, Hedgesville, WV (US)

(73) Assignee: Mack Trucks, Inc., Allentown, PA (US)

( * ) Notice: Subject to any disclaimer, the term of this patent is extended or adjusted under 35 U.S.C. 154(b) by 0 days.

(21) Appl. No.: 09/401,844

(22) Filed: Sep. 22, 1999

(51) Int. Cl.[7] ..... F02D 13/04
(52) U.S. Cl. ..... 123/321
(58) Field of Search ..... 123/321, 322, 123/320, 90.16, 90.24, 90.23

(56) References Cited

U.S. PATENT DOCUMENTS

| | | | | |
|---|---|---|---|---|
| 2,002,196 | | 5/1935 | Ucko . | |
| 3,332,405 | | 7/1967 | Haviland . | |
| 3,809,033 | | 5/1974 | Cartledge | 123/90.46 |
| 4,572,114 | | 2/1986 | Sickler | 123/321 |
| 4,592,319 | | 6/1986 | Meistrick | 123/321 |
| 4,664,070 | | 5/1987 | Meistrick et al. | 123/21 |
| 4,711,210 | | 12/1987 | Reichenbach | 123/321 |
| 4,793,307 | | 12/1988 | Quenneville et al. | 123/323 |
| 4,944,256 | | 7/1990 | Matayoshi et al. | 123/90.24 |
| 5,255,650 | | 10/1993 | Faletti et al. | 123/322 |
| 5,507,261 | | 4/1996 | Johnson, Jr. | 123/322 |
| 5,526,784 | * | 6/1996 | Hakkenberg et al. | 123/322 |
| 5,535,710 | | 7/1996 | Zoschke et al. | 123/90.23 |
| 5,537,976 | | 7/1996 | Hu | 123/322 |
| 5,615,653 | | 4/1997 | Faletti et al. | 123/322 |
| 5,655,488 | | 8/1997 | Hampton et al. | 123/90.16 |
| 5,680,841 | | 10/1997 | Hu | 123/322 |
| 5,724,939 | * | 3/1998 | Faletti et al. | 123/322 |
| 5,730,102 | | 3/1998 | Arnold et al. | 123/322 |
| 5,758,620 | | 6/1998 | Warner | 123/321 |
| 6,000,374 | * | 12/1999 | Cosma et al. | 123/321 |

FOREIGN PATENT DOCUMENTS

| | | | |
|---|---|---|---|
| 0302288 | 8/1989 | (EP) | 13/6 |
| 9133031 | 5/1997 | (JP) . | |

* cited by examiner

*Primary Examiner*—Henry C. Yuen
*Assistant Examiner*—Hieu T Vo
(74) *Attorney, Agent, or Firm*—Rothwell, Figg, Ernst & Manbeck

(57) ABSTRACT

A two-cycle compression brake apparatus and braking method is provided according to the invention. The apparatus includes a positive power hydraulic lash adjuster positioned in a travel path of a power rocker arm and being capable of opening an associated at least one valve when a hydraulic fluid is held in the positive power hydraulic lash adjuster, and a compression brake hydraulic lash adjuster positioned on a compression brake rocker arm and positioned over the associated at least one engine valve and being capable of opening the associated at least one valve when a hydraulic fluid is held in the compression brake hydraulic lash adjuster, wherein in a compression braking mode the hydraulic fluid is held in the compression brake hydraulic lash adjuster to actuate the at least one associated valve while the positive power hydraulic lash adjuster does not actuate the at least one associated valve so that at least one exhaust valve is opened near a top dead center position of an associated piston while at least one intake valve is opened near a bottom dead center position of the associated piston to perform the two-cycle engine compression braking.

27 Claims, 10 Drawing Sheets

TWO-CYCLE COMPRESSION BRAKING ON A FOUR STROKE ENGINE USING HYDRAULIC LASH ADJUSTMENT

BACKGROUND OF THE INVENTION

1. Field of the Invention

The present invention relates to the field of engine compression braking.

2. Description of the Background Art

Engine braking is an engine operating mode wherein the engine is reconfigured during operation to provide a braking effect to an associated vehicle. This may be desirable or necessary when regular wheel brakes are inadequate to provide complete braking. An example is a need for powerful and prolonged braking operations on steep grades, such as on mountain roads. Engine braking finds particular applicability on large vehicles having high wheel weights and correspondingly high momentum, and where conventional wheel brakes may fade or fail under high loading conditions or under prolonged use.

A compression type engine brake works by opening intake valves during an intake stroke and by opening exhaust valves at or near the end of the compression stroke of an associated cylinder. During the compression stroke of an engine, the air in a cylinder is compressed, requiring a work input by the engine. In normal engine operation the combustion stroke follows the compression stroke and recoups the work expended during the compression stroke. However, during compression braking, the opening of the exhaust valve near the end of the compression stroke means that no expansion of the compressed air occurs. Instead, the air is simply exhausted from the engine. The net result is that during engine braking operation the engine is not generating power but instead is absorbing power. The engine compression brake is therefore an efficient braking system that can be used as a supplement to or a substitute for conventional wheel brakes, and may be used for repeated and extended braking operations.

Related art compression brakes generally work as four-cycle compression brakes, with one exhaust valve opening event and one intake valve opening event per two crankshaft revolutions. Four-cycle braking is usually done because most large engines are four-cycle in nature, with the valve train designed for one opening event per cycle. However, FIG. 1 shows a graph illustrating the increased braking power available in a two-cycle braking system over a four-cycle braking system. Related art compression braking is therefore much less efficient than it could be.

Related art compression brakes typically rely on a mechanical linkage of some sort to activate the compression brake and to transmit compression braking events to one or more valves. While such linkages are durable, they do not allow for variations. Mechanical linkages are designed for a particular engine and application. Mechanical linkages therefore do not readily accommodate variations such as different timings between engines and different engine timings based on ambient characteristics such as intake air temperature, pressure, or humidity. An additional drawback is that related art compression brakes often require that the normal valve operation be disabled for braking operations. Further, related art compression brakes often rely on additional linkages or devices that exist apart from a valvetrain mechanism, requiring additional expense and modification of an engine in order to function.

Therefore, there remains a need in the art for improvements in engine braking systems.

SUMMARY OF THE INVENTION

A two-cycle compression braking apparatus is provided according to a first aspect of the invention. The two-cycle compression braking apparatus comprises a positive power hydraulic lash adjuster positioned in a travel path of a power rocker arm and being capable of opening an associated at least one valve when a hydraulic fluid is held in the positive power hydraulic lash adjuster, and a compression brake hydraulic lash adjuster positioned on a compression brake rocker arm and positioned over the associated at least one engine valve and being capable of opening the associated at least one valve when the hydraulic fluid is held in the compression brake hydraulic lash adjuster, wherein in a positive power mode the hydraulic fluid is held in the positive power hydraulic lash adjuster to actuate the at least one associated valve while the compression brake hydraulic lash adjuster does not actuate the at least one associated valve, and in a compression braking mode the hydraulic fluid is held in the compression brake hydraulic lash adjuster to actuate the at least one associated valve while the positive power hydraulic lash adjuster does not actuate the at least one associated valve so that at least one exhaust valve is opened near a top dead center position of an associated piston while at least one intake valve is opened near a bottom dead center position of the associated piston to perform the two-cycle engine compression braking.

A method of two-cycle compression braking on a four stroke engine using a hydraulic lash adjustment is provided according to a second aspect of the invention. The method comprises the steps of releasing a hydraulic fluid in a positive power hydraulic lash adjuster, and holding a hydraulic fluid in a compression brake hydraulic lash adjuster, wherein a rocker arm motion is transmitted to at least one exhaust valve and to at least one intake valve to perform two-cycle engine compression braking.

A method of two-cycle compression braking on a four stroke engine using a hydraulic lash adjuster positioned on a rocker arm is provided according to a third aspect of the invention. The method comprises the steps of releasing a hydraulic fluid in a positive power hydraulic lash adjuster, transferring the hydraulic fluid from the positive power hydraulic lash adjuster to a compression brake hydraulic lash adjuster, and holding the hydraulic fluid in the compression brake hydraulic lash adjuster, wherein an exhaust rocker arm motion is transmitted to at least one exhaust valve near a top dead center position of an associated cylinder and an intake rocker arm motion is transmitted to at least one intake valve near a bottom dead center position of said associated cylinder to perform said two-cycle engine compression braking.

The above and other features and advantages of the present invention will be further understood from the following description of the preferred embodiment thereof, taken in conjunction with the accompanying drawings.

DETAILED DESCRIPTION OF THE PREFERRED EMBODIMENTS

Figure 2:
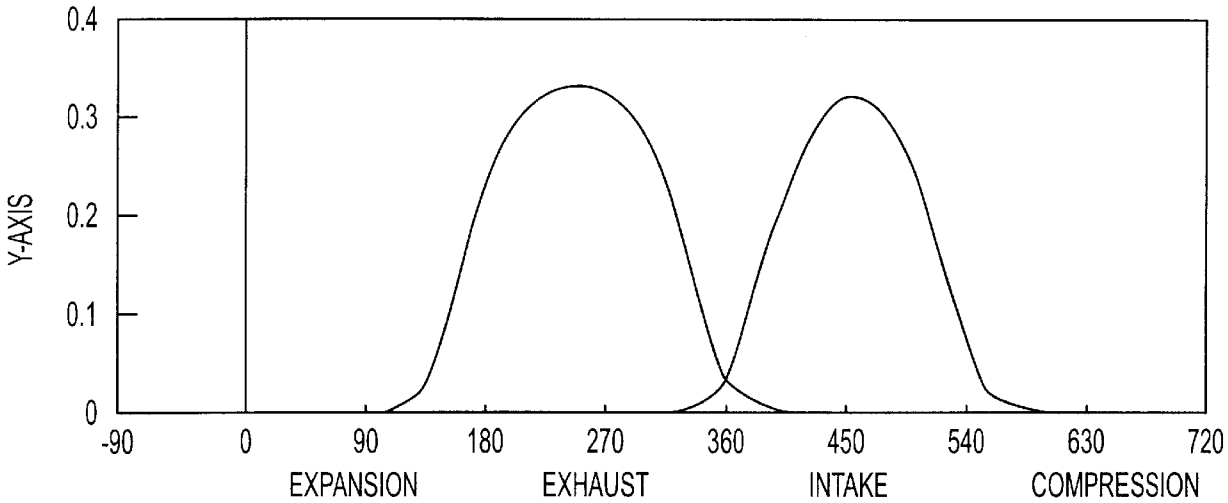
FIG. 2 shows a graph of valve opening events for a normal positive power engine operating mode.

Compression braking takes advantage of the reciprocating motion of an engine's pistons in order to absorb work and perform a braking function. In four-cycle compression braking, the intake valves are opened during an intake stroke to charge the cylinders with air and the exhaust valves are opened at or near the top dead center of a compression stroke to release the compressed air, but without combustion (fuel is generally not present in the cylinders during engine braking). This is somewhat analogous to the normal positive power operating mode shown in the graph of FIG. 2. In the graph, the horizontal axis represents degrees of crankshaft rotation, while the vertical axis represents cam lift (in inches). In the positive power mode, exhaust valve opening events occur between about 100 degrees to about 405 degrees of crankshaft rotation, while intake valve events occur between about 315 degrees to about 595 degrees of crankshaft rotation.

Figure 1:
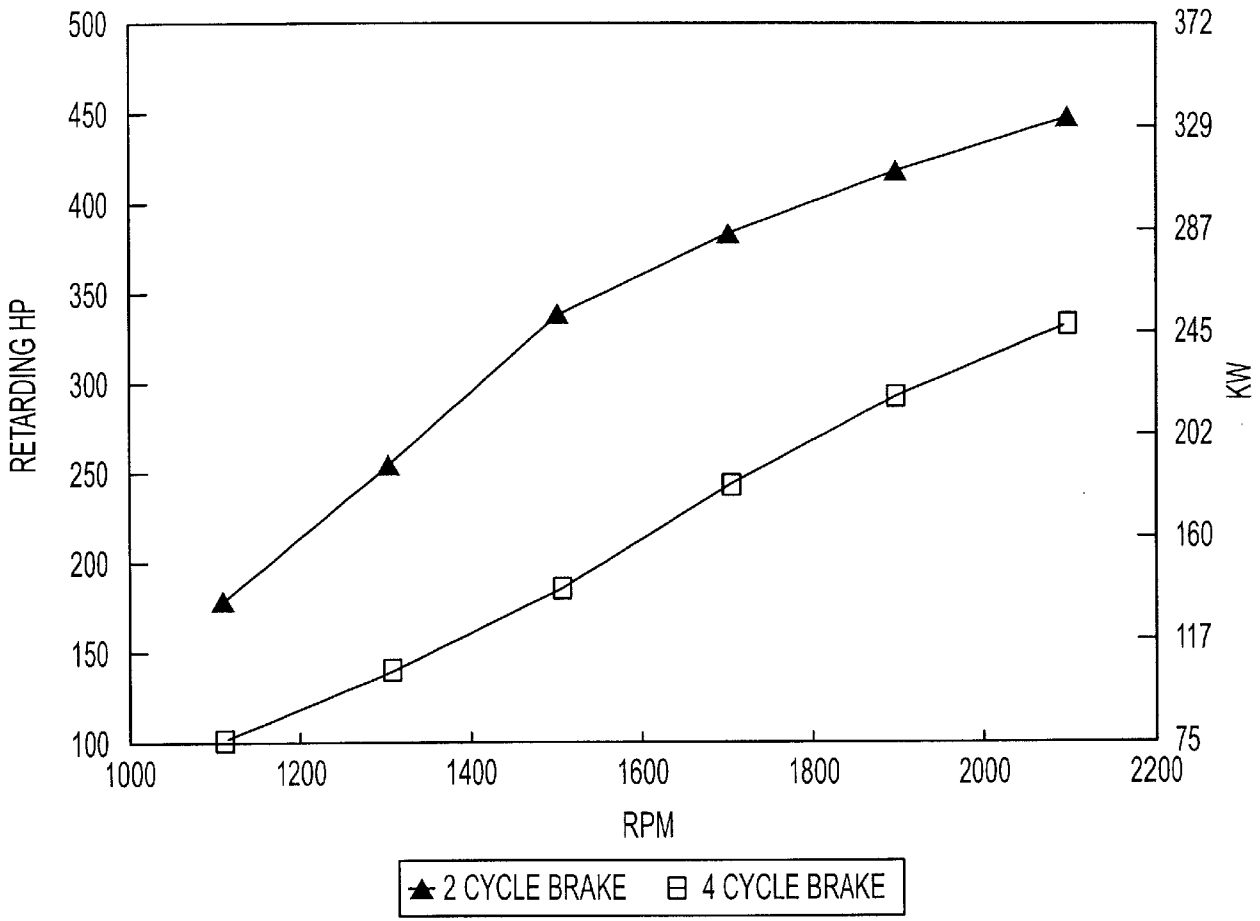
FIG. 1 shows a graph illustrating the increased braking power available in a two-cycle braking system over a four-cycle braking system.
Figure 3:
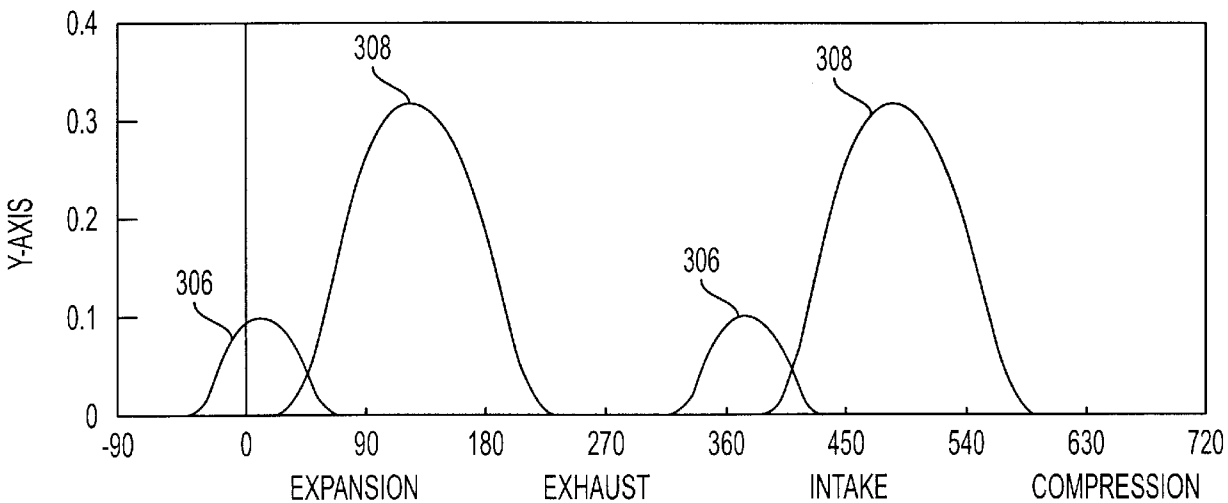
FIG. 3 shows a graph of value opening events for a two-cycle compression braking of the present invention.

FIG. 3 shows a graph of valve opening events for a two-cycle compression braking of the present invention. As can be seen from the graph, in two-cycle compression braking the intake and exhaust valves are opened at each revolution of the crankshaft, yielding additional braking power over a four-cycle compression brake (see FIG. 1). The exhaust valve opening events 306 occur at about −45 degrees and again at about 315 degrees of crankshaft rotation, while the intake valve opening events 308 occur at about 35 degrees and again at about 395 degrees of crankshaft rotation.

Figures 4A, 4B, 4C:
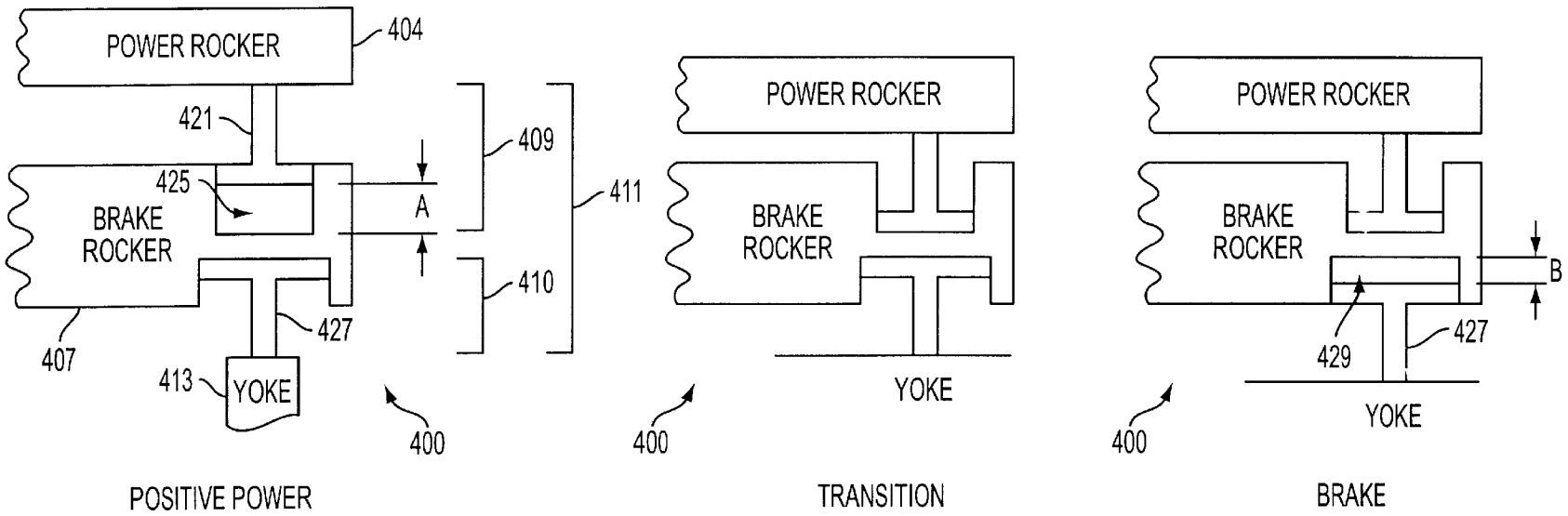
FIGS. 4A–4C show a two-cycle compression braking apparatus of the present invention.

FIGS. 4A–4C show a two-cycle compression braking apparatus 400 of the present invention. The apparatus 400 includes a positive power rocker arm 404, a brake rocker arm 407, a hydraulic lash adjuster 411 comprised of a positive power hydraulic lash adjuster 409 and a compression brake hydraulic lash adjuster 410, and a valve 413. It should be understood that the valve 413 may be a valve stem of an intake or exhaust valve, may be a valve bridge used to actuate multiple valves, or may be a pin or other device used to actuate a valve or valves. It should be further understood that the two hydraulic lash adjusters 409 and 410 may be formed in a single unit or may be independent and may be positioned on separate rocker arms.

The positive power hydraulic lash adjuster 409 includes a positive power piston 421 and a positive power cylinder 425 corresponding to the positive power piston 421. The compression brake hydraulic lash adjuster 410 includes a brake piston 427 and a brake cylinder 429 corresponding to the brake piston 427 (see FIG. 4C).

FIG. 4A shows the apparatus in a positive power (normal running) mode, FIG. 4B shows the apparatus in a transition between the positive power mode and a braking mode, and FIG. 4C shows the apparatus in the braking mode.

A hydraulic fluid normally resides in either the positive power cylinder 425 or the brake cylinder 429. The hydraulic fluid may be moved between the two cylinders as desired to put the engine in either a positive power mode or a compression braking mode. When the hydraulic fluid is held in the positive power cylinder 425, the motion of the power rocker arm 404 is transmitted to the valve 413 via the positive power piston 421 and the brake piston 427. When the hydraulic fluid is released from the positive power cylinder 425 and is held in the brake cylinder 429, the motion of the brake rocker arm 407 is transmitted to the valve 413 via the brake piston 427 (while the motion of the power rocker arm 404 is not transmitted). The hydraulic fluid therefore may be used to selectively actuate the hydraulic lash adjuster 411 in either the positive power mode or the braking mode.

FIGS. 4A and 4C also show the relative travel of the positive power piston 421 with respect to the brake piston 427. The positive power piston 421 in the preferred embodiment travels a longer stroke "A" than the stroke "B" of the brake piston 427. Therefore, in the braking mode, the valves 413 may not be opened as far as in the positive power mode. However, since the purpose of the compression braking mode is to absorb power and not efficiency of air transfer, this is of no consequence.

In the preferred embodiment, control of the hydraulic fluid is accomplished by a pilot valve and two check valves, and will be discussed below in conjunction with FIG. 7. However, the control of the hydraulic fluid may be accomplished by any type of control apparatus.

Figure 5:
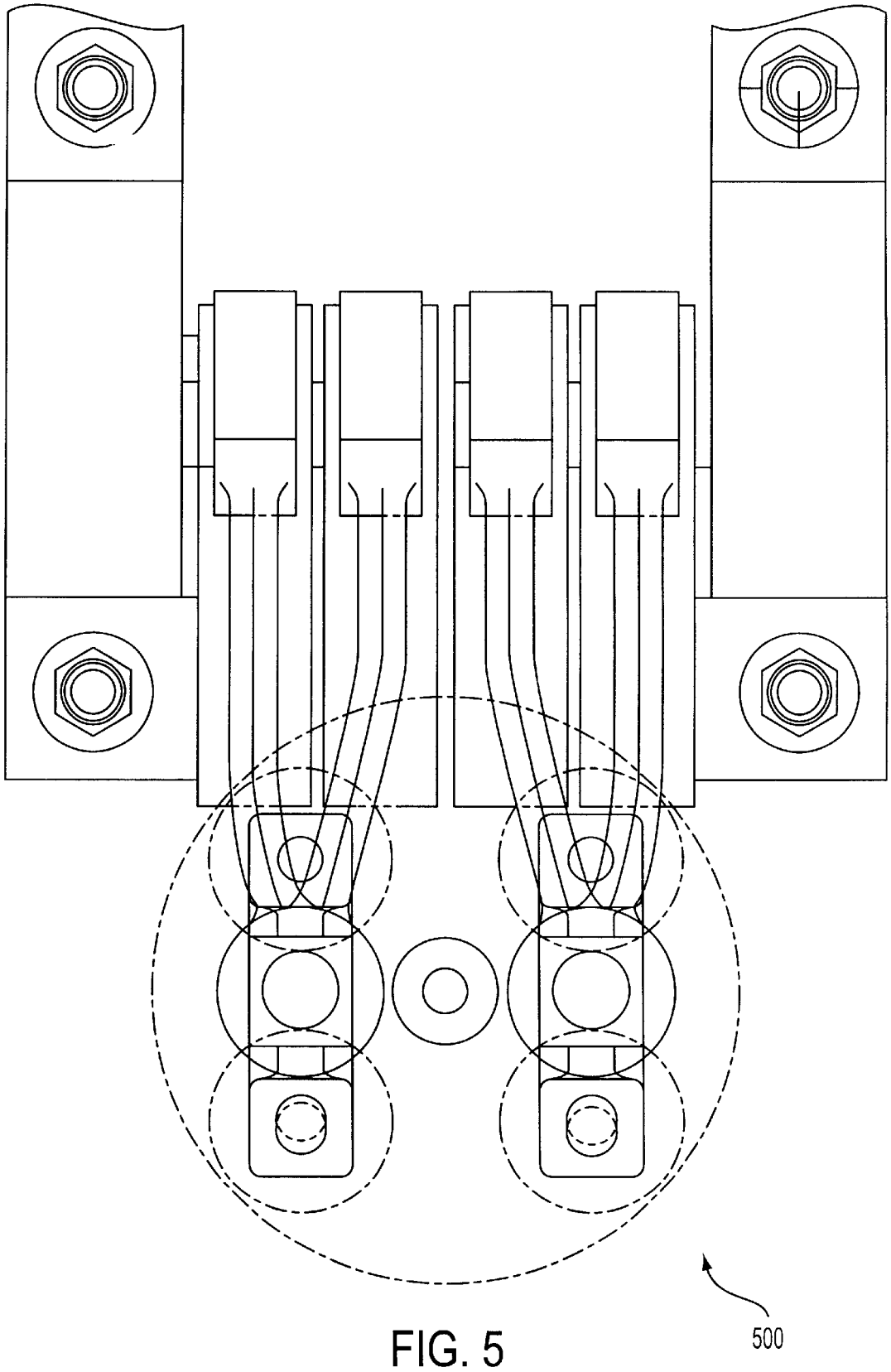
FIGS. 5 and 6 show a first embodiment of a rocker arm and hydraulic lash adjuster configuration.
Figure 6:
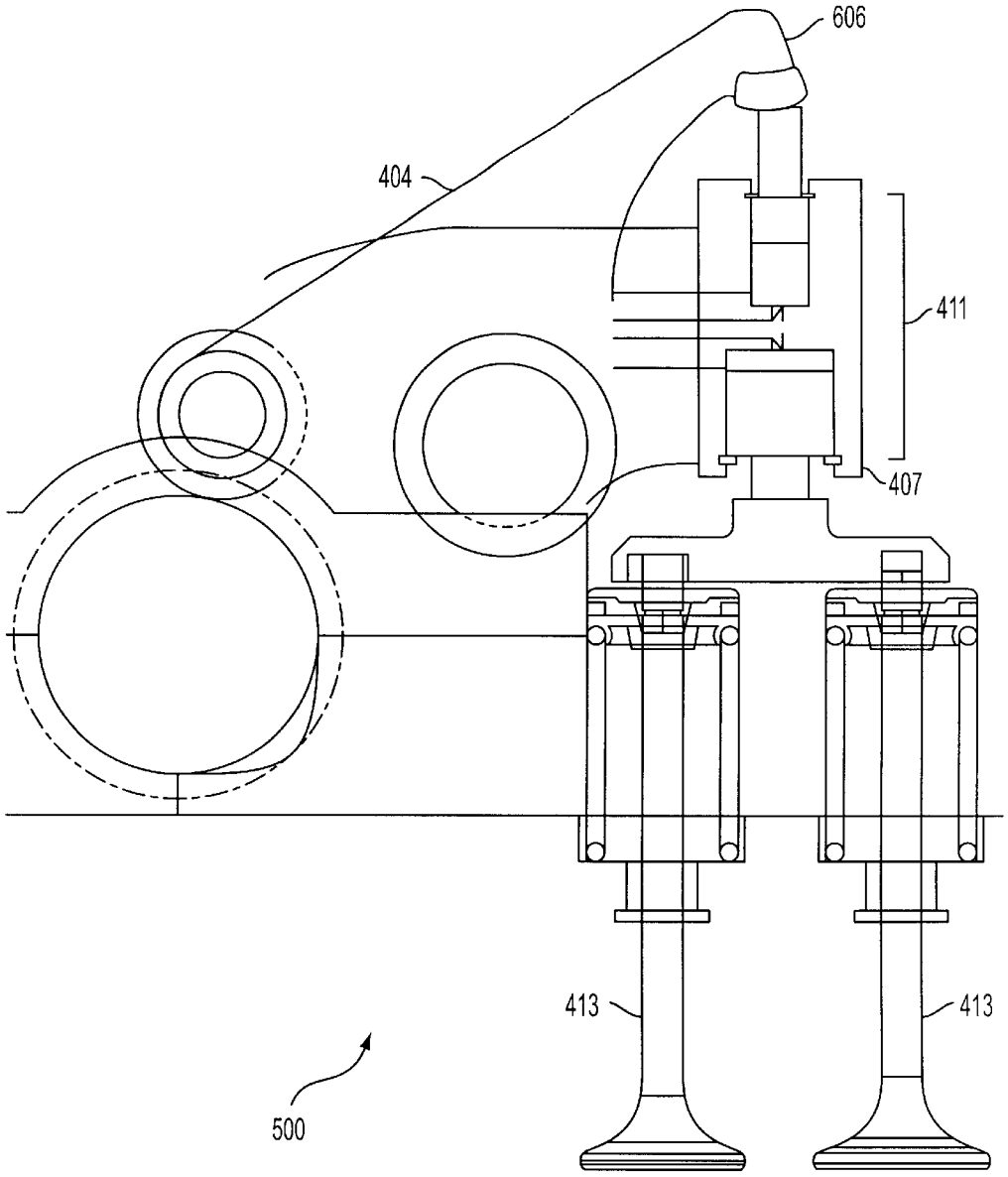

FIGS. 5 and 6 show a first embodiment 500 of a rocker arm and hydraulic lash adjuster configuration. The first embodiment 500 uses only two hydraulic lash adjusters 411 per cylinder. In the first embodiment 500, the pairs of intake and exhaust valves are arranged perpendicular to the associated valvetrain, and the power rocker arms 404 and the brake rocker arms 407 are positioned so that the contact portion 606 of the positive power rocker arm 404 is above the brake rocker arm 407 and the hydraulic lash adjuster 411 (see FIG. 6). In this manner, the hydraulic lash adjuster 411 in a positive power mode may be used by the power rocker arm 404 to actuate the valves 413, while also causing the brake rocker arm 407 to move in response to the motion of the power rocker arm 404.

Figure 7:
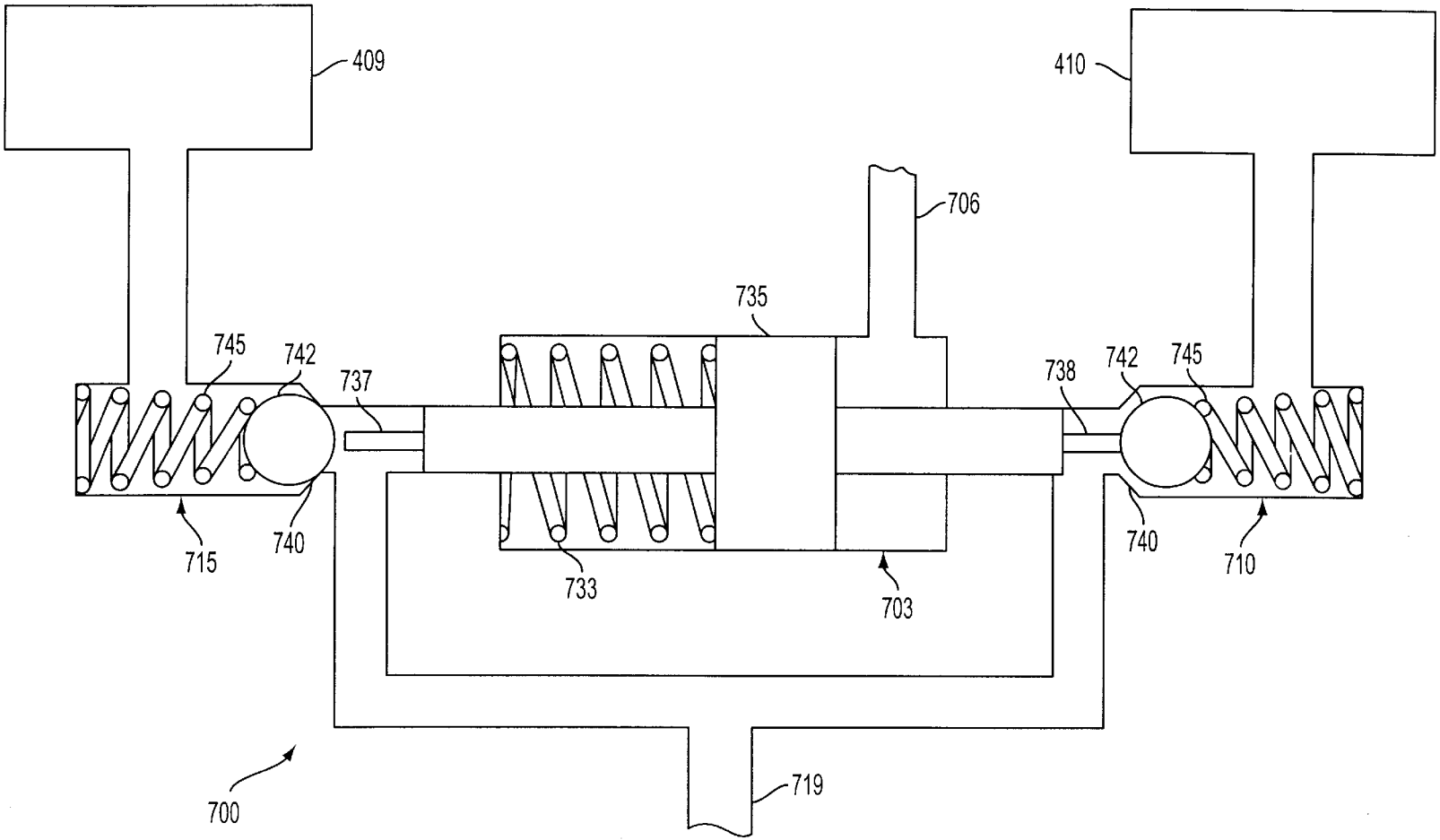
FIG. 7 shows a hydraulic fluid control apparatus for actuating the positive power hydraulic lash adjuster and the compression brake hydraulic lash adjuster.

FIG. 7 shows a hydraulic fluid control apparatus 700 for actuating the positive power hydraulic lash adjuster 409 and the compression brake hydraulic lash adjuster 410. The hydraulic fluid control apparatus 700 includes a pilot value 703 fed by a pilot valve hydraulic fluid line 706, a brake check valve 710, a positive power check valve 715, and a hydraulic fluid supply line 719.

The check valves 710 and 715 include a seat 740, a check ball 742, and a check ball biasing device 745 (such as a spring, for example) that biases the check ball 742 against the seat 740.

The pilot valve 703 includes a biasing device 733 (such as a spring, for example), and a plunger 735. The plunger 735 includes a positive power pin 737 and a brake pin 738, which may actuate either the positive power check valve 715 or the brake check valve 710, respectively. The plunger 735, due to the biasing device 733, normally resides in the pilot valve 703 so that the positive power check valve 715 is closed while the brake check valve 710 is open. Hydraulic fluid trapped in either hydraulic lash adjuster 410 or 409 produces valve motion. Therefore, as a result of this normal position, the hydraulic fluid is held in the positive power hydraulic lash adjuster 409 to keep the engine in the positive power mode.

Hydraulic fluid may be introduced into the pilot valve 703 via the pilot valve hydraulic fluid line 706, which may move the plunger 735 against the biasing device 733. As a result of movement of the plunger 735, the positive power check valve 715 is opened while the brake check valve 710 is closed. The positive power hydraulic lash adjuster 409 is therefore released and the compression brake hydraulic lash adjuster 410 is actuated.

When either check valve is actuated, hydraulic fluid from the other check valve is released, and may flow from the released check valve to the actuated check valve. In addition, the hydraulic fluid supply line 719 may supply additional hydraulic fluid to replace any leaked hydraulic fluid or hydraulic fluid otherwise lost.

In the preferred embodiment, an electric solenoid (not shown) controls the pilot hydraulic fluid supply and therefore controls the intake and exhaust valves through the motion of the pilot valve 703. The hydraulic fluid supply may be of an on/off type, or may rely on a differential pressure.

It should be understood that the hydraulic fluid control apparatus 700 is a preferred embodiment, and other hydraulic fluid control arrangements may be used to actuate the compression brake of the present invention.

Figure 8:
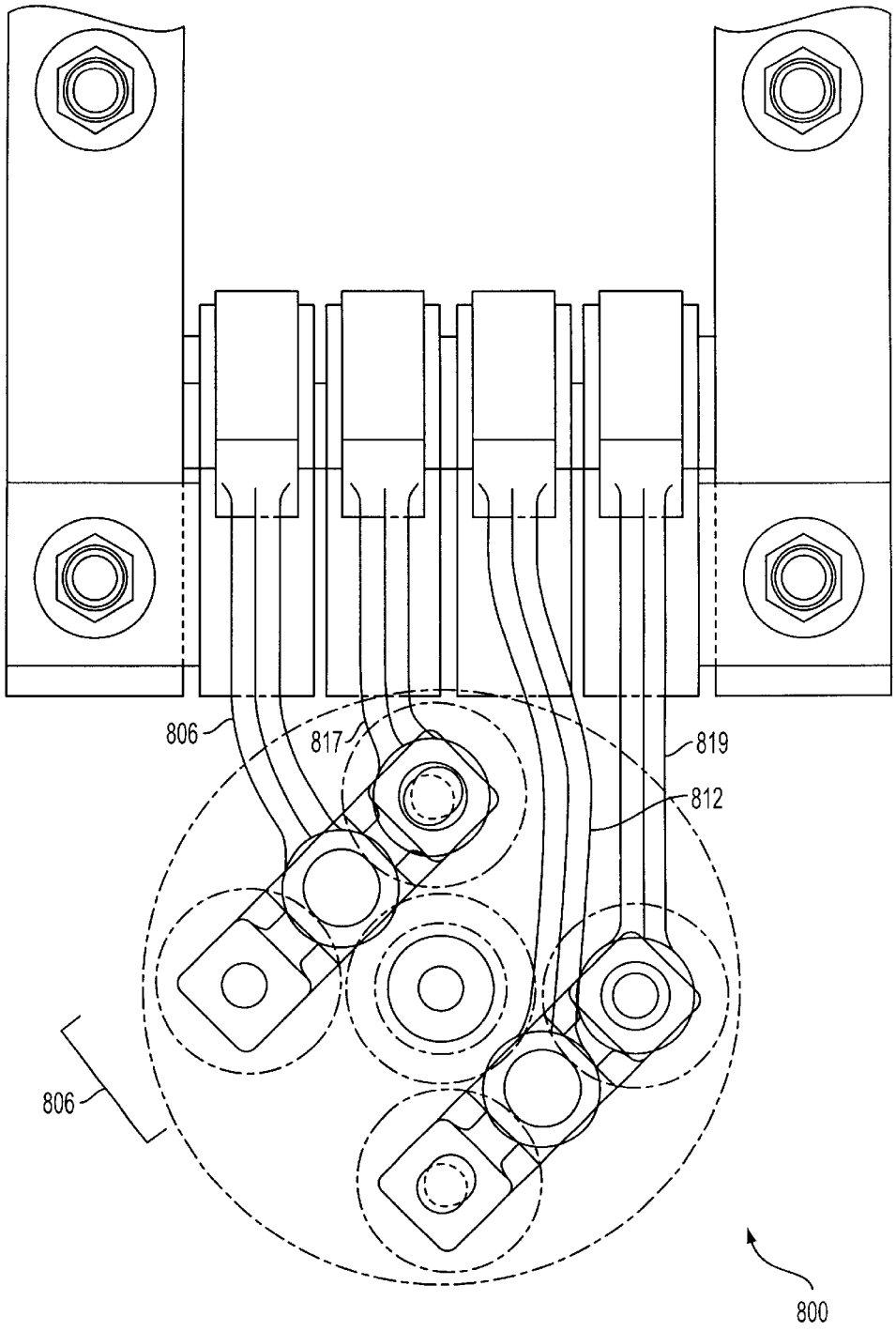
FIGS. 8 and 9 show a second embodiment of a rocker arm and hydraulic lash adjuster configuration.
Figure 9:
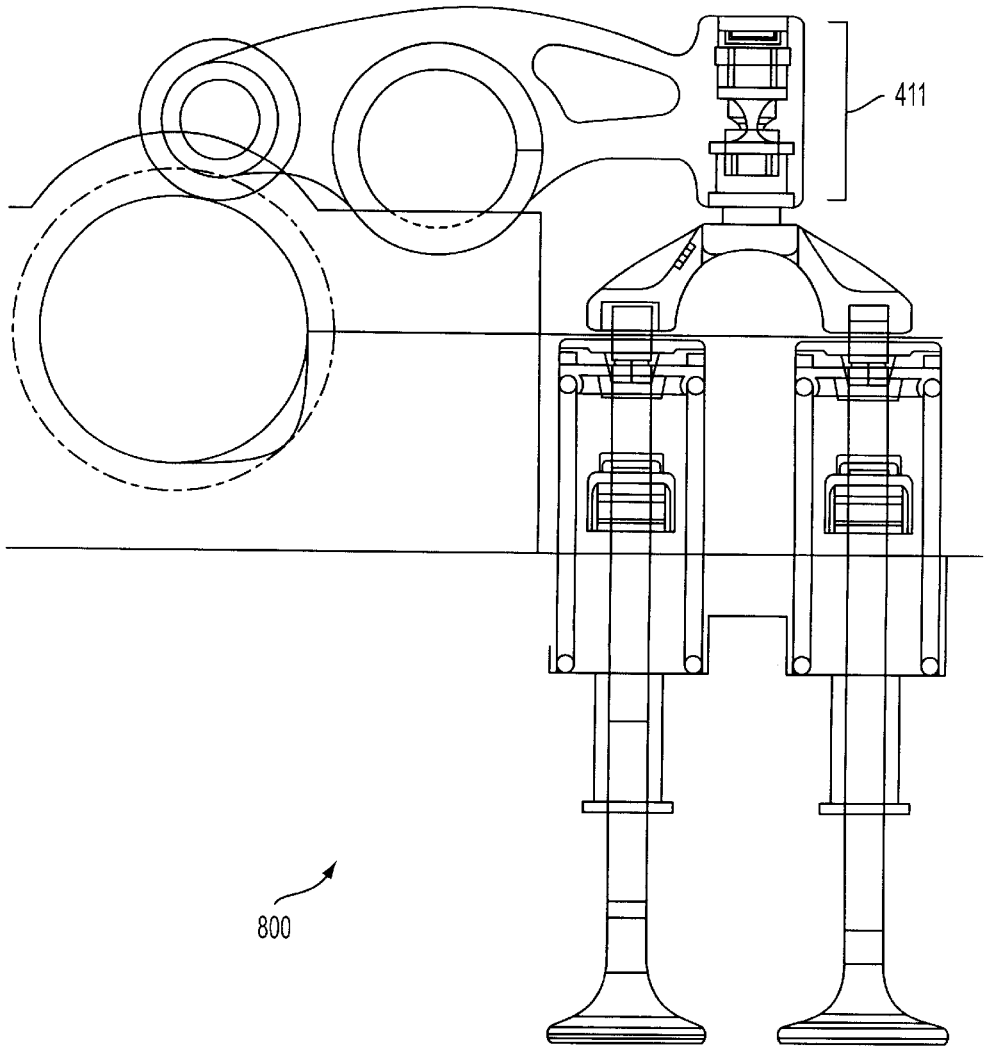

FIGS. 8 and 9 show a second embodiment 800 of a rocker arm and hydraulic lash adjuster configuration. The second embodiment 800 is very similar to the first embodiment 500 except that it uses four single, independent hydraulic lash adjusters 411 per cylinder instead of two combined positive power and compression brake hydraulic lash adjusters. The positive power exhaust rocker arm 806 and the positive power intake rocker arm 812 each have a positive power hydraulic lash adjuster 409 which is filled with hydraulic fluid in the positive power mode. The brake exhaust rocker arm 817 and the brake intake rocker arm 819 each have a compression brake hydraulic lash adjuster 410 which opens only a single valve of the valve pair in order to perform compression braking. During compression braking, the positive power hydraulic lash adjusters 409 bleed down while the compression brake hydraulic lash adjusters 410 pump up.

Preferably, the compression brake of the present invention uses four rocker arms and four cam lobes per cylinder. One or more camshafts (having four cam lobes per cylinder) may be used to activate the four rocker arms. The four cam lobes consist of well understood positive power intake and exhaust cam events, along with two lobes which include two-cycle brake intake and exhaust cam events.

As an additional feature of the present invention. The compressed air from the opening of the exhaust valves during compression braking may be delivered to a turbocharger. The turbocharger increases the pressure of the intake air charge and therefore boosts overall performance of the compression brake by requiring more power input to compress the already partially compressed intake air charge.

Figure 10:
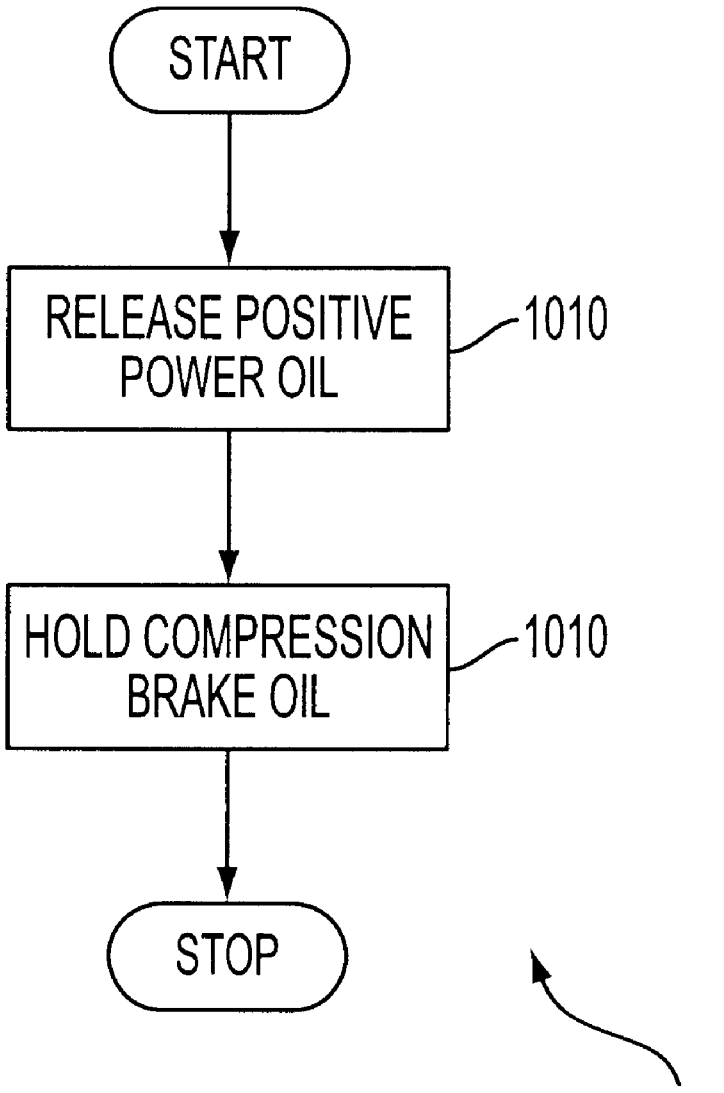
FIG. 10 shows a flowchart of a first embodiment of a method of the present invention.

FIG. 10 shows a flowchart 1000 of a first embodiment of a method of the present invention. In step 1010, the hydraulic fluid in a positive power hydraulic lash adjuster 409 is released. This disables the positive power mode functions of the positive power rocker arms 404 as part of the transition from the positive power mode to the two-cycle compression braking mode. Because the positive power hydraulic lash adjuster 409 has a stroke that is substantially equal to a positive power valve event plus a brake valve event, release of the hydraulic fluid in the positive power hydraulic lash adjuster 409 disables the positive power opening of the valves.

In step 1020, the hydraulic fluid is held in the compression brake hydraulic lash adjuster 410 in order to transmit the motion of the brake rocker arms 407 to valves 413 in order to perform compression braking. This may be accomplished by transmitting the rocker arm motion to a valve stem, valve bridge, or pin or other device in order to open valves for compression braking. The valve train therefore may include a compression brake camshaft that has two-cycle compression brake intake and exhaust cam lobes.

Figure 11:
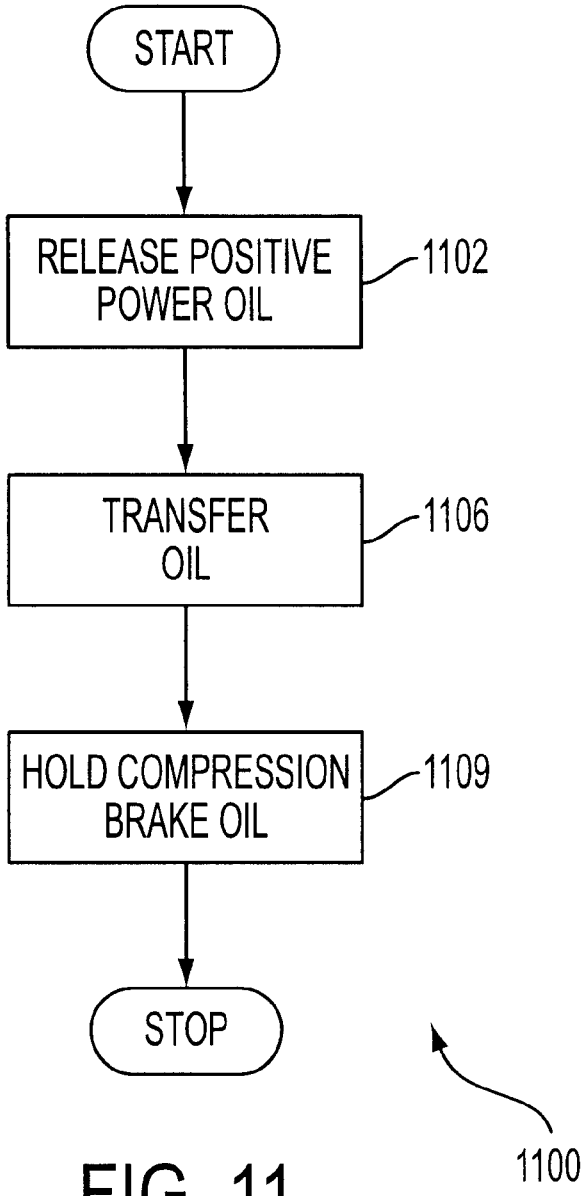
FIG. 11 shows a flowchart of a second embodiment of a method of the present invention.

FIG. 11 shows a flowchart 1100 of a second embodiment of a method of the present invention. In step 1102, the hydraulic fluid in a positive power hydraulic lash adjuster 409 is released. This disables the positive power mode functions of the positive power rocker arms 404 as part of the transition from the 1 positive power mode to the two-cycle compression braking mode. Because the positive power hydraulic lash adjuster 409 has a stroke that is substantially equal to a positive power valve event plus a brake valve event, release of the hydraulic fluid in the positive power hydraulic lash adjuster 409 disables the positive power opening of the valves.

In step 1106, the hydraulic fluid released from the positive power hydraulic lash adjuster 409 is transferred to the compression brake hydraulic lash adjuster 410.

In step 1109, the hydraulic fluid is held in the compression brake hydraulic lash adjuster 410 in order to transmit the motion of the brake rocker arms 407 to the valves 413 in order to perform compression braking. This may be accomplished by transmitting the rocker arm motion to a valve stem, valve bridge, or pin or other device in order to open valves for compression braking. The valve train therefore may include a compression brake camshaft that has two-cycle compression brake intake and exhaust cam lobes.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A two-cycle compression brake apparatus, comprising:

a positive power hydraulic lash adjuster positioned in a travel path of a power rocker arm and being capable of opening an associated at least one valve when a hydraulic fluid is held in said positive power hydraulic lash adjuster; and a compression brake hydraulic lash adjuster positioned on a compression brake rocker arm and positioned over said associated at least one engine valve and being capable of opening said associated at least one valve when said hydraulic fluid is held in said compression brake hydraulic lash adjuster;

wherein in a positive power mode said hydraulic fluid is held in said positive power hydraulic lash adjuster to actuate said at least one associated valve while said compression brake hydraulic lash adjuster does not actuate said at least one associated valve, and in a compression braking mode said hydraulic fluid is held in said compression brake hydraulic lash adjuster to actuate said at least one associated valve while said positive power hydraulic lash adjuster does not actuate said at least one associated valve so that at least one exhaust valve is opened near a top dead center position of an associated piston while at least one intake valve is opened near a bottom dead center position of said associated piston to perform said two-cycle engine compression braking.

2. The two-cycle compression brake apparatus of claim 1, wherein said positive power hydraulic lash adjuster contacts said compression brake hydraulic lash adjuster to transmit a motion of said power rocker arm to said associated at least one engine valve.

3. The two-cycle compression brake apparatus of claim 1, wherein said positive power hydraulic lash adjuster is located over a valve bridge while said compression brake hydraulic lash adjuster is independently located over a single valve.

4. The two-cycle compression brake apparatus of claim 1, wherein during a transition from a positive power mode to a braking mode said hydraulic fluid from said positive power hydraulic lash adjuster is transferred to said compression brake hydraulic lash adjuster.

5. The two-cycle compression brake apparatus of claim 1, wherein a rocker arm motion is transmitted to a valve stem.

6. The two-cycle compression brake apparatus of claim 1, wherein a rocker arm motion is transmitted to a valve bridge.

7. The two-cycle compression brake apparatus of claim 1, wherein said compression brake hydraulic lash adjuster has a stroke that is substantially equal to a valve brake event.

8. The two-cycle compression brake apparatus of claim 1, wherein said positive power hydraulic lash adjuster has a stroke that is substantially equal to a valve brake event plus a valve power events.

9. The two-cycle compression brake apparatus of claim 1, wherein compressed air from an opening of an exhaust valve is delivered to a turbocharger which in turn increases a pressure of an intake charge and therefore increases overall compression braking performance.

10. The two-cycle compression brake apparatus of claim 1, wherein an associated at least one camshaft includes two-cycle compression brake intake and exhaust valve lobes.

11. The two-cycle compression brake apparatus of claim 1, wherein said positive power hydraulic lash adjuster and said compression brake hydraulic lash adjuster form a hydraulic lash adjuster unit.

12. The two-cycle compression brake apparatus of claim 1, wherein said compression brake hydraulic lash adjuster partially opens said at least one associated valve in said compression braking mode.

13. A method of two-cycle compression braking on a four stroke engine using a hydraulic lash adjustment, comprising the steps of:

releasing a hydraulic fluid in a positive power hydraulic lash adjuster; and holding a hydraulic fluid in a compression brake hydraulic lash adjuster;

wherein a rocker arm motion is transmitted to at least one exhaust valve and to at least one intake valve to perform two-cycle engine compression braking.

14. The two-cycle compression braking method of claim 13, further including a step of transferring said hydraulic fluid from said positive power hydraulic lash adjuster to said compression brake hydraulic lash adjuster after said releasing step.

15. The two-cycle compression braking method of claim 13, wherein said rocker arm motion is transmitted to a valve stem.

16. The two-cycle compression braking method of claim 13, wherein said rocker arm motion is transmitted to a valve bridge.

17. The two-cycle compression braking method of claim 13, wherein said compression brake hydraulic lash adjuster has a stroke that is substantially equal to a brake valve event.

18. The two-cycle compression braking method of claim 13, wherein said positive power hydraulic lash adjuster has a stroke that is substantially equal to a brake valve event plus a positive power valve event.

19. The two-cycle compression braking method of claim 13, wherein compressed air from an opening of an exhaust valve is delivered to a turbocharger which in turn increases a pressure of an intake charge and therefore increases overall compression braking performance.

20. The two-cycle compression braking method of claim 13, wherein at least one associated camshaft includes two-cycle compression brake intake and exhaust cam lobes.

21. A method of two-cycle compression braking on a four stroke engine using a hydraulic lash adjuster positioned on a rocker arm, comprising the steps of:

releasing a hydraulic fluid in a positive power hydraulic lash adjuster;

transferring said hydraulic fluid from said positive power hydraulic lash adjuster to a compression brake hydraulic lash adjuster; and holding said hydraulic fluid in said compression brake hydraulic lash adjuster;

wherein an exhaust rocker arm motion is transmitted to at least one exhaust valve at or near a top dead center position of an associated cylinder and an intake rocker arm motion is transmitted to at least one intake valve at or near a bottom dead center position of said associated cylinder to perform said two-cycle engine compression braking.

22. The two-cycle compression braking method of claim 21, wherein said rocker arm motion is transmitted to a valve stem.

23. The two-cycle compression braking method of claim 21, wherein said rocker arm motion is transmitted to a valve bridge.

24. The two-cycle compression braking method of claim 21, wherein said compression brake hydraulic lash adjuster has a stroke that is substantially equal to a brake valve event.

25. The two-cycle compression braking method of claim 21, wherein said positive power hydraulic lash adjuster has a stroke that is substantially equal to a brake valve event plus a positive power valve event.

26. The two-cycle compression braking method of claim 21, wherein compressed air from an opening of an exhaust valve is delivered to a turbocharger which in turn increases a pressure of an intake charge and therefore increases overall compression braking performance.

27. The two-cycle compression braking method of claim 21, wherein at least one associated camshaft includes two-cycle compression brake intake and exhaust cam lobes.

* * * * *